United States Patent [19]

Delano

[11] Patent Number: 4,481,780

[45] Date of Patent: Nov. 13, 1984

[54] PROCESS FOR THE GENERATION OF A COLD GAS

[75] Inventor: Mark A. Delano, White Plains, N.Y.

[73] Assignee: Union Carbide Corporation, Danbury, Conn.

[21] Appl. No.: 568,909

[22] Filed: Jan. 6, 1984

[51] Int. Cl.[3] ..... F17C 7/02

[52] U.S. Cl. ..... 62/52; 62/49; 62/70

[58] Field of Search ..... 62/52, 49, 68, 69, 70

[56] References Cited

U.S. PATENT DOCUMENTS

| | | | |
|---|---|---|---|
| 3,058,317 | 10/1962 | Putman | 62/52 |
| 3,106,070 | 10/1963 | Harper et al. | 62/52 |
| 4,140,736 | 2/1979 | Nielsen et al. | 62/69 |
| 4,343,634 | 8/1982 | Davis | 62/52 |

*Primary Examiner*—Ronald C. Capossela
*Attorney, Agent, or Firm*—Saul R. Bresch

[57] ABSTRACT

In a process for the generation of a cold gas comprising introducing a relatively warm gas and a liquid cryogen into the upstream end of a mixing zone; permitting the gas and liquid cryogen to mix in the mixing zone, the amount of gas being sufficient to vaporize the liquid cryogen; and withdrawing the cold gas downstream in the mixing zone, the improvement comprising:

(a) choking the gas prior to its entry into the mixing zone;

(b) providing a linear mixing zone having, at its downstream end, a dead end; and (c) withdrawing the cold gas as a slipstream from the mixing zone at a point intermediate between its upstream end and the dead end provided that the distance from the upstream end to the dead end is at least twice the distance from the upstream end to the point of withdrawal of the slipstream.

3 Claims, 1 Drawing Figure

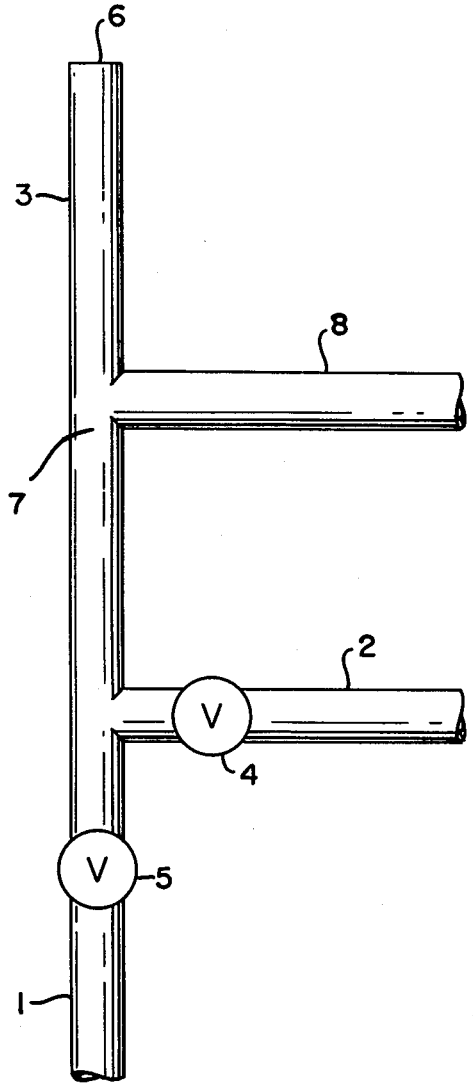
6
3
8
7
2
V
4
V
5
1

PROCESS FOR THE GENERATION OF A COLD GAS

TECHNICAL FIELD

This invention relates to a process for generating a cold gas from a gas at ambient temperature and a liquid cryogen.

BACKGROUND ART

Cold gas, i.e., gas having a temperature in between ambient and liquid cryogen temperature, has long been useful in industrial applications involving the cooling of product or equipment. Processes for its generation lend themselves to ancillary tecnhiques for dehumidification and the removal of impurities, and have been found useful in the cooling and precipitation hardening of honeycomb panels for airplanes, brazing, cooling powder metals, and condensing vapors.

The known processes for cold gas generation, unfortunately, require relatively large or more pieces of apparatus, operator intervention, and/or process monitoring control systems. Mechanical refrigeration, on the other hand, is expensive, does not lend itself to intermittent operation, is less simple to maintain and operate, and is not as reliable.

BRIEF DESCRIPTION OF THE DRAWING

The sole FIGURE of the drawing is a schematic diagram of a cold gas generator in which the process of the invention can be carried out.

DISCLOSURE OF INVENTION

An object of the invention is to provide a cold gas generating process resulting in a constant mass flow of cold gas at a constant temperature, which can be simply switched on or off in order to meet cold gas requirements.

Other objects and advantages will become apparent hereinafter.

According to the present invention, an improvement has been discovered in a process for the generation of a cold gas comprising introducing a relatively warm gas and a liquid cryogen into the upstream end of a mixing zone; permitting the gas and liquid cryogen to mix in the mixing zone, the amount of gas being sufficient to vaporize the liquid cryogen; and withdrawing the cold gas downstream in the mixing zone.

The improvement comprises:

(a) choking the gas prior to its entry into the mixing zone;

(b) providing a linear mixing zone having, at its downstream end, a dead end; and (c) withdrawing the cold gas as a slipstream from the mixing zone at a point intermediate between its upstream end and the dead end provided that the distance from the upstream end to the dead end is at least twice the distance from the upstream end to the point of withdrawal of the slipstream.

DETAILED DESCRIPTION

Cold gas generation involves the mixing of a relatively warm gas with a liquid cryogen. The term "relatively warm" means that the gas is warmer than the liquid cryogen, but it may nevertheless be at a low temperature. Since the objective is to obtain a gas, the warm gas should be sufficient both in temperature and quantity to vaporize the liquid cryogen. Generally, both the gas and the cryogen are inert and they are preferably of the same chemical composition. The most commonly used gas and cryogen for this purpose is nitrogen, and both the gas and the liquid cryogen are obtained from conventional sources. While the temperature of the gas can range from just above the temperature of the liquid cryogen to ambient and above, ambient is the temperature of choice.

Whenever a liquid cryogen and a gas at a higher temperature are mixed, there is a transfer of heat from the gas to the cryogen. This heat transfer results in the partial or total vaporization of the cryogen depending on the relative proportions of the components being mixed and the initial temperature of the gas. When cold gas is to be generated, the proportions of warm gas and cryogen are arranged such that total vaporization of the cryogen occurs. This is accompanied by pressure fluctuations or pulsations in the mixing area. These pressure pulsations are often of sufficient magnitude to stagnate the inlet flow of warm gas resulting in an outlet flow of cold gas with a temperature that varies with respect to time. One way of overcoming this problem is to use a shell and tube heat exchanger to first vaporize the liquid cryogen within the tube and, then, to mix the vaporized cryogen with the gas in the downstream section of the shell of the heat exchanger. Subject process overcomes the problem in a different, and simpler, manner.

Referring to the drawing:

In a typical case, nitrogen gas at ambient temperature is introduced at inlet pipe 1 by opening inlet valve 5. The inlet pressure of the gas is pre-set such that a choked flow condition will always exist across valve 5. In the absence of a chocked flow, the flow rate across inlet valve 5 changes in proportion to the changes in the pressure drop. The term "choking" means that the pressure of the gas being introduced is at a high enough level to propel the gas across valve 5 at a flow rate, which is at least equal to sonic speed or Mach 1. This frees the flow of gas from pressure changes taking place in mixing zone 7. In other words, the inlet flow cannot be stagnated or dampened by pressure fluctuations in mixing zone 7.

As noted, mixing zone 7 is linear, i.e., the zone is constructed so that it conforms to a straight line. Pipe 3 provides this construction. The zone is dead-ended or capped as represented by dead end 6. This dead end serves to dampen pulsations in cold gas outlet 8 and the area between cold gas outlet 8 and dead end 6 provides adequate capacity to insure thorough mixing in mixing zone 7.

The liquid cryogen, liquid nitrogen in this case, is introduced at inlet pipe 2 by opening inlet valve 4. The flow rate of the liquid nitrogen is conventional, i.e., in the range of about one standard cubic foot per minute (scfm) to about 1000 scfm. The liquid cryogen and gas enter mixing zone 7 where the bulk of the liquid cryogen is vaporized and is mixed together with the gas. Some droplets of liquid cryogen remain, however, and these droplets proceed in a straight line along pipe 3 and against dead end 6 where they vaporize, expand and are forced back into the cold gas mixture.

A slipstream of cold gas is taken off pipe 3 at cold gas outlet pipe 8. This outlet pipe is preferably perpendicular to pipe 3, but can be situated at various angles to pipe 3. Although angles of 45 to 135 degrees or even greater can be used, the efficiency of the cold gas generation decreases with each degree of variation from the perpendicular. The interspatial placement of the various inlet and outlet pipes is not critical, however, and inlet pipes 1 and 2 can be at almost any angle to pipe 3 provided, of course, that both are feeding into the upstream end. It is not suggested, however, the the direction of flow of each inlet stream is such that the inlet gas opposes the inlet liquid as this would be counterproductive.

The distance from the upstream end of mixing zone 7 to dead end 6 should be at least twice the distance from the upstream end to the point of withdrawal of the slipstream, and preferably at least four times the distance. Within this constraint, the distance from the upstream end to dead end 6 will generally be at least four flow diameters and will usually be from ten to thirty flow diameters while the distance from the upstream end to the point of slipstream withdrawal will generally be at least one flow diameter and preferably at least three flow diameters. A "flow diameter" means the internal diameter of a pipe, in this case of pipe 3.

In the event that there are condensable components in the gas, a condensate drain can be added to the cold gas generator. In practice, the cold gas generator is insulated with the exception of valve activators.

The materials from which the cold gas generator can be made are copper, brass, and AISI 300 series stainless steel or other alloys suitable for cryogenic temperature service.

Two equations which reflect the conditions prevailing in the process are as follows:

$$P_1+P_{ATM}>2(P_2+P_{ATM})$$

$$P_3>P_2$$

wherein:

$P_1$ = the inlet gas pressure at valve 5

$P_{ATM}$ = atmospheric pressure $P_{2B}$ = the gas pressure at the upstream end of mixing zone 7

$P_3$ = the liquid cryogen pressure at valve 4

The flow rate of the liquid cryogen across valve 4 is proportional to $P_3$ minus $P_2$; the inlet flow rate of the gas is constant; and the slipstream of cold gas is at a constant temperature with respect to time after transient cool down is completed.

The invention is illustrated by the following example:

A cold gas generator similar to that shown in the drawing is provided. The liquid cryogen inlet pipe 2 and the cold gas outlet pipe 8 are perpendicular to pipe 3 and are in the same plane. Pipe 3 is merely an extension of gas inlet pipe 1 with connecting valve 5 in between. The device is in the horizontal mode, i.e., the axes of all the pipes are parallel to the floor.

Pipe 1 and pipe are 3¾ inch (nominal diameter) brass pipes and pipes 2 and 8 are ¾ inch (internal diameter) copper tubing. Liquid nitrogen is supplied through pipe 2 from a conventional cylinder. Gaseous nitrogen is supplied through pipe 1, also from a conventional source. Temperatures are measured with a type "T" thermocouple having a digital "Omega" read out.

Gas inlet pressure is measured prior to choking, which is accomplished by reducing the size of the orifice in valve 5 to a point at which the flow rate (velocity of the gas through the orifice) reaches Mach 1. This provides a constant mass flow at the upstream end of pipe 3.

The number of flow diameters from the upstream end of pipe 3 to dead end 6 is 25. The number of flow diameters from the upstream end of pipe 3 to the beginning of pipe 8 is 12.

Variables and results are noted in the Table below. All runs are started after transient cool down is complete.

It is found that the combination of choked inlet gas and dampening of outlet pulsations at dead end 6 produces a cold gas of constant temperature and constant mass flow at outlet 8. The constant mass flow at outlet 8 can be observed, i.e., in the choked condition, a constant flow of a white fog can be seen. The white fog is due to the condensation of water vapor in the air. In the unchoked condition, on the other hand, puffs of the white fog are observed rather than the constant flow. This puffing represents the pulsations or fluctuations in pressure discussed above.

TABLE

| Run | Gas Inlet Pressure (psig) Choked or Unchoked | Liquid Inlet Pressure (psig) | Gas Inlet Temperature (°F.) | Time in minutes and seconds Beginning of Run | End of Run | Cold Gas Outlet Temperature (°F.) Begin/End |
|---|---|---|---|---|---|---|
| 1 | 25 (choked) | 25 | 58 to 61 | 0:00 | 9:00 | −232/−232 |
| 2 | 30 (choked) | 25 | 58 to 61 | 0:00 | 10:00 | −203/−203 |
| 3 | 35 (choked) | 25 | 58 to 61 | 0:00 | 11:00 | −180/−180 |
| 4 | 35 (choked) | 25 | 58 to 61 | 0:00 | 7:00 | −245/−245 |
| 5 | 20 (choked) | 23 | 72 | 11:00 | 14:00 | −160/−160 |
| 6 | 25 (unchoked) | 32.5 | 70 | 43:00 | 46:00 | −193/−189 |
| 7 | 25 (unchoked) | 32.5 | 70 | 48:00 | 51:00 | −265/−245 |
| 8 | 30 (unchoked) | 27.5 | 53 | 9:00 | 12:00 | −234/−232 |
| 9 | 35 (unchoked) | 27.5 | 53 | 21:30 | 27:30 | −219/−215 |

I claim:

1. In a process for the generation of a cold gas comprising introducing a relatively warm gas and a liquid cryogen into the upstream end of a mixing zone; permitting the gas and liquid cryogen to mix in the mixing zone, the amount of gas being sufficient to vaporize the liquid cryogen; and withdrawing the cold gas downstream in the mixing zone, the improvement comprising:

(a) choking the gas prior to its entry into the mixing zone;

(b) providing a linear mixing zone having, at its downstream end, a dead end; and (c) withdrawing the cold gas as a slipstream from the mixing zone at a point intermediate between its upstream end and the dead end provided that the distance from the upstream end to the dead end is at least twice the distance from the upstream end to the point of withdrawal of the slipstream.

2. The process defined in claim 1 wherein the intermediate point referred to in step (c) is about halfway between the upstream end of the mixing zone and the dead end.

3. The process defined in claim 1 wherein the distance from the upstream end to the dead end is at least four times the distance from the upstream end to the point of withdrawal of the slipstream.

* * * * *